United States Patent [19]

Korpijaakko

[11] Patent Number: 4,515,741

[45] Date of Patent: May 7, 1985

[54] METHOD FOR MAKING AMBIDIRECTIONAL PRESSED CERAMIC SLIP-ON SUPPORT FOR A TOWEL BAR

[75] Inventor: Pekka Korpijaakko, Rocky Hill, N.J.

[73] Assignee: Willette Corporation, New Brunswick, N.J.

[21] Appl. No.: 364,553

[22] Filed: Apr. 1, 1982

[51] Int. Cl.[3] ..... B28B 1/44; B28B 3/00; B28B 7/16

[52] U.S. Cl. ..... 264/62; 264/56; 264/318; 264/319

[58] Field of Search ..... 264/60, 62, 67, 56, 264/154, 318, 319

[56] References Cited

U.S. PATENT DOCUMENTS

| | | | |
|---|---|---|---|
| D. 101,210 | 9/1936 | Conners | D6/103 |
| D. 128,782 | 8/1941 | Hallenscheid | D6/103 |
| 1,034,533 | 8/1912 | Thalheimer | 411/366 |
| 1,752,683 | 4/1930 | Meagher | 248/251 |
| 2,492,945 | 1/1950 | Balthaser | 248/251 |
| 2,715,468 | 8/1955 | Waltz | 211/123 |
| 2,821,006 | 1/1958 | Pfannmueller | 264/67 |
| 3,550,784 | 12/1970 | Batts | 211/116 |
| 4,166,833 | 9/1979 | Schurman | 264/154 X |
| 4,188,178 | 2/1980 | Anscher | 425/469 |
| 4,294,635 | 10/1981 | Hurley | 264/60 |

FOREIGN PATENT DOCUMENTS

| | | | |
|---|---|---|---|
| 383774 | 11/1932 | United Kingdom | 264/67 |

*Primary Examiner*—Jan Silbaugh

*Attorney, Agent, or Firm*—Sperry, Zoda & Kane

[57] ABSTRACT

A support and method for making same is disclosed for use in supporting towel bars. The support is made of pressed ceramic material and is a slip-on support which is ambidirectional such as to be capable of receiving a towel bar extending in either lateral direction. Each side aperture is formed during pressing by non-movable mold protrusions moving perpendicular to the axis of the lateral aperture in the finally pressed ceramic support. These side facing apertures are created by the formation of a downwardly extending channel and an upwardly extending channel on each side of the support which are contiguous with one another and thereby define an approximately square laterally facing and towel bar receiving aperture in each side face. Simultaneously, the mounting slot is formed in the base section of the pressed ceramic slip-on support to facilitate detachable securement with respect to a mounting bracket which may be fixedly secured with respect to the surrounding environmental structure.

7 Claims, 4 Drawing Figures

METHOD FOR MAKING AMBIDIRECTIONAL PRESSED CERAMIC SLIP-ON SUPPORT FOR A TOWEL BAR

BACKGROUND OF THE INVENTION

1. Field of the Invention

The present invention deals with the field of towel bar supports generally. Such devices are normally located in conventional bathrooms, lavatories, or other locations where towels are dried or placed for easy usage. The present invention deals more particularly with respect to the field of ceramic towel posts or supports and is further restricted to that field of ceramic towel posts wherein the ceramic is formed by pressing.

Many pressed ceramic towel bar supports are designed to be secured to the surrounding environmental structure by being cemented into the interior wall area. The present invention does not apply to those type of designs but is particularly limited to the pressed ceramic towel bar supports which are more easily detachable with respect to the wall structure. In particular, this class of towel bar supports includes a bracket member which is fixedly secured with respect to the surrounding environmental structure such as a wall and is designed to receive a pressed ceramic slip-on towel bar support mounted thereon. Such supports normally define a slot means in the base area thereof for securely mounting to the bracket means.

2. Description of the Prior Art

A variety of types of towel bar supports are shown in U.S. Pat. Nos. D-101,210; D-128,782; 1,034,533; 1,752,683; 2,492,945; 2,705,568; 2,715,468; 2,821,006; 3,550,784; 4,188,178. Many of these designs show towel bar supports which are removable, but none of these designs disclose the slip-on pressed ceramic ambidirectional towel post formed during pressing by a single pressing step wherein the molds do not include movable members.

In order to form a ceramic support with a pressing operation which moves in one plane only, it is of great difficulty to form an aperture facing perpendicular to that plane of movement. In the present case we see the side facing aperture for receiving a bar which is formed with the axis of that aperture perpendicular to the direction of movement of the pressing means. Those portions of the support construction which are, on the other hand, oriented parallel with respect to the direction of movement of the pressing means are conventionally formed. In this instance the cleat slot is so oriented. Heretofore, the stationary mold means would include a separate member such as a rectangular block which would be placed into the mold during formation of the support in order to form the side aperture and would be removed from the final product after removal from the mold. With the present invention a means and method is disclosed for forming the side aperture without requiring this separate labor step. Such a separately removable mold member requires substantial amount of additional time during the formation step as well as requiring much maintenance, time and expense. If it is at all possible to form a pressed fixture, without requiring such separately movable pieces, that process is certainly preferable. The present design provides such a novel process by the formation of side facing apertures by the wiping of an upwardly and downwardly projecting member which essentially wipe one another to form the side facing aperture while the slot in the base area is formed at the same time without the necessity of a removable piece in order to release the pressed piece from the mold cavity.

SUMMARY OF THE INVENTION

The present invention provides a method for making an ambidirectional pressed ceramic slip-on support for a towel bar which includes a stationary first mold member as well as a usually movable second mold member. Each member defines a respective cavity which when mated with respect to one another defines the three-dimensional outer boundary of the article to be pressed. In the present design each mold member includes a protrusion means as well as a wiping surface being defined on the protruding means.

The first wiping surface of the first mold member is designed to wipe against the second wiping surface of a second mold member during movement of the molds toward one another. This wiping forms channels in the side surfaces of the pressed ceramic support in such a fashion as to define an approximately square side facing aperture in each opposite side thereof simultaneously with forming of a cleat slot in the base thereof.

Once the first and second mold members have moved to their completely closed positions, they will then be separated by conventional means and the pressed ceramic support may be ejected from the second mold member by contacting of an ejection rod or similar configuration with respect to the bottom surface thereof. After removal the pressed ceramic slip-on towel bar support is conventionally processed by being dried and fettled. Thereafter, a glaze material is sprayed upon the support and it is fired in a conventional fashion.

The formed ambidirectional pressed ceramic slip-on support is adapted to be secured to the surrounding wall configuration by a mounting bracket. A mounting bracket means is designed to be fixedly secured to such an environmental structure and is mated with a mounting slot means defined in the base section of the pressed ceramic support.

A body section is fixedly secured with respect to the base section and is preferably integral with respect thereto. This body section extends outwardly from the base section opposite from the point of location with respect to the mounting slot means. The body section includes an upper surface as well as a lower surface and two laterally facing opposite side surfaces. Each of the side surfaces defines an upper channel means extending down from the top surface past the midway point of the side surface. Similarly, each side surface defines a lower channel means which extends from the lower surface up the side surface past the midway point thereof. These two channel means are adjacent to one another and as such are contiguous to thereby define a side facing aperture. This side facing aperture may be of any configuration, but preferably is approximately square in cross-section to thereby receive a conventional towel bar therein.

It is an object of the present invention to provide an ambidirectional pressed ceramic slip-on support for a towel bar which is capable of receiving a towel bar in either opposite side surfaces.

It is an object of the present invention to provide an ambidirectional pressed ceramic slip-on support for a towel bar which is easily detachable and attachable with respect to any surrounding environmental structure.

It is an object of the present invention to provide an ambidirectional pressed ceramic slip-on support for a towel bar which is formed by a pressing operation performed by a single vertical movement.

It is an object of the present invention to provide an ambidirectional pressed ceramic slip-on support for a towel bar which is formed in a pressing mold which does not include any separately movable members or plugs other than the first and second mold means.

It is an object of the present invention to provide an ambidirectional pressed ceramic slip-on support for a towel bar which is more easily maintained and less expensive to operate than previously designed methods which utilize separately movable mold pieces.

It is an object of the present invention to provide an ambidirectional pressed ceramic slip-on support for a towel bar which utilizes an upper and lower protruding means which wipe one another to form a side facing aperture in both sides of the final unit.

It is an object of the present invention to provide an ambidirectional pressed ceramic slip-on support for a towel bar which facilitates removal of the product from the mold after forming thereof.

It is an object of the present invention to provide an ambidirectional pressed ceramic slip-on support which is usable in a left direction or a right direction thereby eliminating inventory problems associated with maintaining both a supply of left members and right members, thereby further simplifying production and marketing.

It is an object of the present invention to provide an ambidirectional pressed ceramic slip-on support for a towel bar which decreases the time required for formation of a single given unit.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 3:
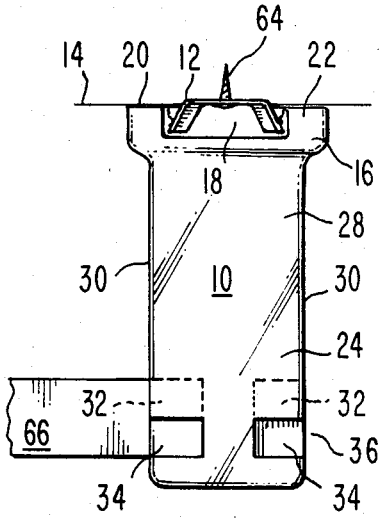
FIG. 3 is a bottom plan view of an embodiment of a slip-on support as in the present invention shown with a towel bar held therein.
Figure 4:
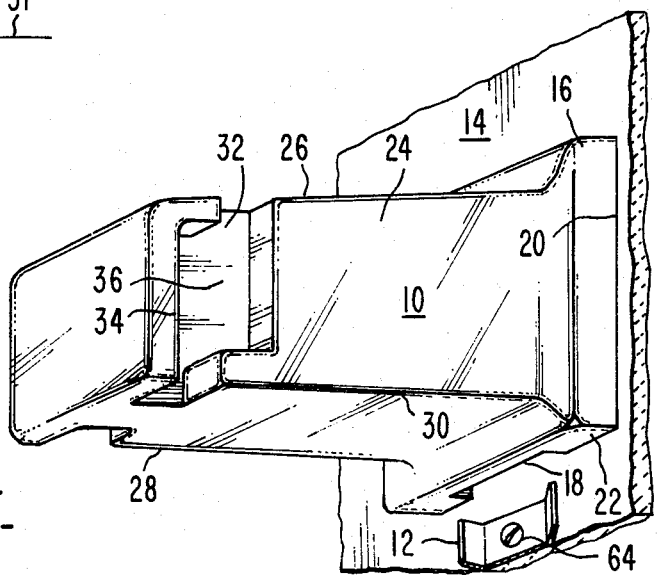
FIG. 4 is a perspective view of an embodiment of an ambidirectional pressed ceramic slip-on support for a towel bar shown being slipped onto a surrounding environmental structure.

The present invention discloses a pressed ceramic towel bar support 10 which is adapted to be detachably securable with respect to a wall 14 by a mounting bracket means 12 as best shown in FIGS. 3 and 4.

A mounting slot means 18 is defined within the base section 16 to facilitate detachable securement with respect to mounting bracket means 12. Preferably the mounting slot means 18 extends along the bottom surface 20 of base section 16 and extends through the upper edge 22 thereof.

The support for a towel bar 66 is provided by body section 24 which is secured with respect to the base sections 16. Preferably the body section 24 and the base section 16 are a single integral unit as shown in FIG. 3. This body section includes an upper surface 26 when viewed in the position shown in FIG. 3 in attachment with respect to a wall. Also, a lower surface 28 and two oppositely facing side surfaces 30 are defined about the outer periphery thereof.

A mounting aperture means 36 is preferably defined in each opposite side surface 30 being of approximately square cross-section and facing oppositely outwardly. The mounting aperture means is formed by contiguous positioning of an upper channel means 32 and a lower channel means 34 defined in both side surfaces.

In particular, the upper channel means 32 extends from the top surface down along the side surface past the center line 31 of the side surface to a position somewhat short of contacting the lower surface. Similarly, the lower channel emeans 34 extends from the lower surface up the side surface past center line 31 to a point somewhat short of the upper surface 26. By placement of the upper channel means 32 and lower channel means 34 immediately adjacent to one another such as to be contiguous with respect to one another and by each of them extending past center line 31 they will form a side facing mounting aperture means 36 in each opposite side surface 30 of support 10 and in this manner provide a means for mounting of a towel bar 66 therein in either such direction.

Figure 1:
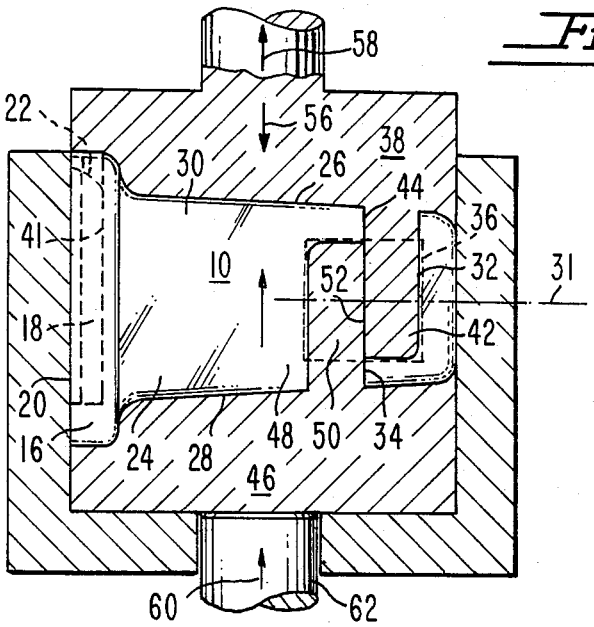
FIG. 1 shows a side cross-sectional view of an embodiment of the method for forming a pressed ceramic support of the present invention.

The usage of two contiguous channels to form the mounting aperture means 36 in each side surface is particularly useful in view of the novel method for making a pressed ceramic slip-on support disclosed in the present invention. This method includes a second mold member 38 defining a second cavity 40 including a second mold protruding means 42 and a trapezoidal cleat forming protrusion 41. Similarly, a first mold member 46 will define a first cavity 48 therein including a first mold protruding means 50. Either of the molds can be moved with respect to one another during formation of the support but in the configuration shown in FIGS. 1 and 2 the first mold member 46 is stationary and the second mold member 38 is movable upwardly and downwardly. After formation the second mold member 38 moves upwardly and then the first mold member 46 moves upwardly to allow product removal.

The pressed ceramic support is formed with a mounting slot means 18 in the lower surface thereof by the chosen configuration of the trapezoidal cleat forming protrusion 41 of the second mold member 38. This slot is defined such that it will extend out through the upper edge 22 of the base section 16.

In order to form a mounting aperture means 36 in one or both of the side surfaces 30, a second wiping surface 44 is preferably defined on the side of the second mold protruding means 42 adjacent to the first mold protruding means 50. Similarly, the first mold protruding means 50 defines a first wiping surface 52 on the side thereof adjacent to the second mold protruding means 42. In this manner after placement of the ceramic material 54 into the mold the second mold member 38 will move downwardly in the pressing direction shown by arrows 56. During this movement, the first wiping surface 52 and the second wiping surface 44 will "wipe" one another and thereby press and remove ceramic material 54 from therebetween and in this manner upon completion of pressing movement 56 create a single contiguous side facing aperture 36 in one or both side surfaces 30.

This is a novel means for forming such a side facing aperture. Heretofore, such surfaces were formed by a separate mold member placed into the cavity when the primary and secondary mold members are moved together. This separate piece thereby enters the product from the side to cause the aperture. After the product is removed from the mold the separate piece is removed from the product piece. Such separately movable mold members inherently have high maintenance requirements and increase the time and handling required for forming a single unit.

With the present invention a single pressing movement 56 is used to form apertures with axes perpendicular to this direction of movement simultaneously with the formation of a mounting cleat parallel to the pressing direction. In this manner no separately movable mold pieces are required.

Figure 2:
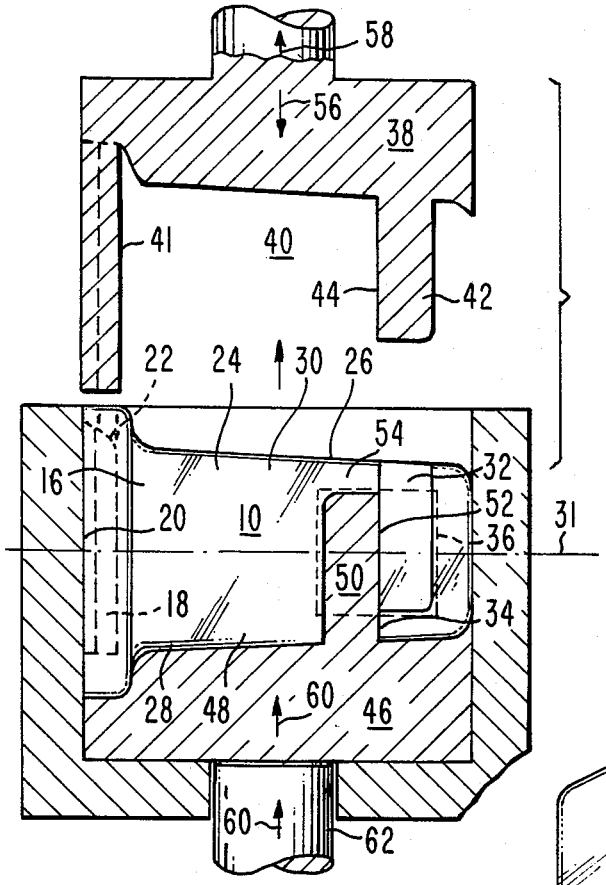
FIG. 2 is an illustration of the embodiment in FIG. 1 showing separation of the two mold members.

In order to effect removal as shown best in FIG. 2 the second mold member 38 is moved upwardly in the direction of arrow 58. After this movement it is necessary to remove the product itself from the remaining portion of the first mold member 46. This ejection can be effected in a variety of different ways, however, with the configuration shown in FIGS. 1 and 2, an ejector rod 62 is secured to the lower portion of first mold member 46. The ejector rod moves upwardly in the direction shown by arrow 60 causing the first mold member 46 to move upwardly out of the molding chamber and allow removal of the product therefrom.

The entire design is adapted to be secured to a wall by a bracket securement means 64 which is adapted to secure the mounting bracket means 12 with respect to the surrounding environmental structure.

It should be appreciated that the present design provides an ambidirectional pressed ceramic slip-on support. Normally with some towel bar supports, direction is of little importance since the unit itself can be merely inverted such that a hole which originally extended to the left can extend to the right or vice versa. However, with a slip-on support there is no means for inverting the towel bar support and, as such, full inventory is required for both left hand and right hand units. Such inventories are rarely equal as they should be and thus present complications to inventory control and shipping. With the present design a single unit will have left hand and right hand orientation and will also be more easily formed merely by a single direction of pressing movement as in normally configured pressed ceramic towel bar supports.

While particular embodiments of this invention have been shown in the drawings and described above, it will be apparent that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A method for making an ambidirectional pressed ceramic slip-on support for a towel bar comprising:

(a) forming a first mold member defining a first cavity therein and including a first mold protruding means extending upwardly therefrom adjacent a side wall defining the first cavity to define a first wiping surface therealong;

(b) forming a second mold member defining a second cavity therein and including a second mold protruding means extending downwardly therefrom adjacent a side wall defining the second cavity to define a second wiping surface therealong extending parallel with respect to said first wiping surface;

(c) depositing ceramic material into the first mold member;

(d) pressing the first mold member and the second mold member together and the first cavity and the second cavity together to press the ceramic material into the desired shape within the cavities, the direction of said pressing being parallel with respect to the planes of said first and second wiping surfaces;

(e) wiping the first wiping surface against the second wiping surface during said pressing to define by the first and second mold protruding means a laterally facing external opening within the pressed ceramic material which is perpendicular to the direction of pressing movement;

(f) removing said first mold member from contact with said second mold member to facilitate removal of the pressed ceramic support; and (g) ejecting of the pressed ceramic support from the first mold member.

2. The method as defined in claim 1 further including after said ejecting;

(a) drying of the pressed ceramic support;

(b) fettling thereof;

(c) spraying of the pressed ceramic support with glaze; and (d) firing of the glazed pressed ceramic support.

3. The method as defined in claim 1 wherein said first mold means remains stationary throughout the method.

4. The method as defined in claim 1 wherein said ejecting is performed by an ejector rod selectively adapted to move the first mold means upwardly to allow newly pressed ceramic supports to be removed from the first cavity.

5. The method as defined in claim 1 wherein the first mold member and the second mold member each includes more than one wiping surface each to form more than one external opening on the sidewalls of the pressed ceramic support.

6. The method as defined in claim 1 wherein the first mold member and the second mold member each include two complementary wiping surfaces to form perpendicular side openings in the pressed ceramic support at diametrically opposite locations thereon.

7. A method for making an ambidirectional pressed ceramic slip-on support for a towel bar comprising:

(a) forming a stationary first mold member defining a first cavity therein and including a first mold protruding means extending upwardly therefrom adjacent a side wall defining the first cavity to define a first wiping surface therealong;

(b) forming a second mold member defining a second cavity therein and including a second mold protruding means extending downwardly therefrom adjacent a side wall defining the second cavity to define a second wiping surface therealong extending parallel with respect to said first wiping surface;

(c) depositing ceramic material into the first mold member;

(d) pressing the first mold member and the second mold member together and the first cavity and the second cavity together to press the ceramic material into the desired shape within the cavities, the direction of said pressing being parallel with respect to the planes of said first and second wiping surfaces;

(e) wiping the first wiping surface against the second wiping surface during said pressing to define by the first and second mold protruding means a laterally facing external opening within the pressed ceramic material which is perpendicular to the direction of pressing movement;

(f) removing said first mold member from contact with said second mold member to facilitate removal of the pressed ceramic support;

(g) ejecting of the pressed ceramic support from the first mold member by upward movement of an ejector rod through the first mold means to abut the newly pressed ceramic support and urge same out of the first cavity thereof;

(h) drying of the pressed ceramic support;

(i) fettling thereof;

(j) spraying of the pressed ceramic support with glaze; and (k) firing of the glazed pressed ceramic support.

* * * * *